US007350687B2

(12) United States Patent
Sanchez et al.

(10) Patent No.: US 7,350,687 B2
(45) Date of Patent: Apr. 1, 2008

(54) TAMPER RESISTANT ENVELOPE

(75) Inventors: Luis A. Sanchez, Hamden, CT (US); Jay Reichelsheimer, Shelton, CT (US)

(73) Assignee: Pitney Bowes Inc., Stamford, CT (US)

( * ) Notice: Subject to any disclaimer, the term of this patent is extended or adjusted under 35 U.S.C. 154(b) by 565 days.

(21) Appl. No.: 10/996,272

(22) Filed: Nov. 23, 2004

(65) Prior Publication Data

US 2006/0108405 A1 May 25, 2006

(51) Int. Cl.
*B65D 27/14* (2006.01)
*B65D 33/14* (2006.01)

(52) U.S. Cl. ..... 229/80; 383/5

(58) Field of Classification Search ..... 229/80; 383/5

See application file for complete search history.

(56) References Cited

U.S. PATENT DOCUMENTS

| | | | | | |
|---|---|---|---|---|---|
| 1,201,519 | A | * | 10/1916 | Sorensen | 229/80 |
| 1,336,646 | A | * | 4/1920 | Mendenhall | 229/81 |
| 1,928,180 | A | * | 9/1933 | Leas | 229/82 |
| 2,088,068 | A | * | 7/1937 | Overbaugh, Jr. | 229/83 |
| 2,181,252 | A | * | 11/1939 | Vogel | 229/80 |
| 2,457,809 | A | * | 1/1949 | Drummond | 229/81 |
| 3,489,332 | A | | 1/1970 | Knittel | 229/80 |
| 3,574,153 | A | * | 4/1971 | Sirota | 428/350 |
| 3,853,262 | A | | 12/1974 | Tucker et al. | 229/80 |
| 3,895,755 | A | * | 7/1975 | McCarthy | 229/83 |
| 4,457,430 | A | * | 7/1984 | Darling et al. | 206/459.1 |
| 4,709,396 | A | | 11/1987 | Voshall et al. | 383/5 |
| 5,194,114 | A | | 3/1993 | Walter | 156/442.1 |
| 5,391,136 | A | | 2/1995 | Makowka | 493/210 |
| 5,433,782 | A | | 7/1995 | Filbert et al. | 118/266 |
| 5,814,183 | A | | 9/1998 | Miller | 156/442.2 |
| 6,048,098 | A | | 4/2000 | Vetter | 383/5 |
| 6,193,825 | B1 | | 2/2001 | Dolan | 156/64 |
| 6,270,256 | B1 | * | 8/2001 | Todman | 383/5 |
| 6,402,015 | B1 | | 6/2002 | Collins | 229/74 |

* cited by examiner

*Primary Examiner*—Jes F. Pascua
(74) *Attorney, Agent, or Firm*—George M. Macdonald; Angelo N. Chaclas

(57) ABSTRACT

In accordance with one embodiment, a tamper resistant envelope comprises a first panel with an interior and an exterior side. The envelope further comprises a second panel attached to the first panel to define an interior portion having opposite side edges, a closed edge portion and an opening portion opposite the closed edge portion to provide access to the interior portion of the tamper resistant envelope; and a flap for sealingly adhering to an exterior surface of the first panel. The flap has an interior and an exterior side and is attached to the second panel at an edge of the second panel opposite the closed edge portion. The flap comprises thereon a first adhesive layer on the interior side of the flap comprising a first remoistenable adhesive deposited on the flap; a solid dye deposited on a portion of the first adhesive layer, wherein the dye is not visible on the exterior side of the flap; and a second adhesive layer comprising a second remoistenable adhesive deposited over the dye to encapsulate the dye. The dye is capable of being released upon contact with steam to provide a visual indication of the dye and an indication of tampering.

23 Claims, 5 Drawing Sheets

TAMPER RESISTANT ENVELOPE

BACKGROUND OF THE INVENTION

1. Field of the Invention

The present invention relates to security envelopes and, more particularly, to a tamper resistant envelope including a tamper evident sealing system.

2. Background Information

Various types of envelopes exist to provide security of the contents contained therein. A disadvantage of some security envelopes, however, is that they can be opened and resealed without the authority or knowledge of the recipient. Thus, the contents may be removed, altered or otherwise accessed in such a way that the recipient may not become aware of such tampering. For example, it is known that conventional paper envelopes can be easily opened with the use of steam and the contents therein thus accessed. The opened envelope can then be resealed by remoistening the glue of the opened envelope without leaving any evidence of the tampering. Accordingly, there is a need for a tamper resistant envelope that provides an indication of unauthorized access.

SUMMARY OF THE INVENTION

In accordance with one aspect of the invention, a tamper resistant envelope comprises a first panel with an interior and an exterior side. The tamper resistant envelope further comprises a second panel attached to the first panel to define an interior portion having opposite side edges, a closed edge portion and an opening portion opposite the closed edge portion to provide access to the interior portion of the tamper resistant envelope; and a flap for sealingly adhering to an exterior surface of the first panel. The flap has an interior and an exterior side and is attached to the second panel at an edge of the second panel opposite the closed edge portion. The flap comprises thereon a first adhesive layer on the interior side of the flap comprising a first remoistenable adhesive deposited on the flap; a solid dye deposited on a portion of the first adhesive layer, wherein the dye is not visible on the exterior side of the flap; and a second adhesive layer comprising a second remoistenable adhesive deposited over the dye to encapsulate the dye. The dye is capable of being released upon contact with steam to provide a visual indication of the dye and an indication of tampering.

In accordance with another aspect of the invention, a method of making a tamper resistant envelope comprises: providing an envelope comprising a first panel with an interior and an exterior side; a second panel attached to the first panel to define an interior portion having opposite side edges, a closed edge portion and an opening portion opposite the closed edge portion to provide access to the interior portion of the envelope; and a flap for sealingly adhering to an exterior surface of the first panel. The flap has an interior and an exterior side and is attached to the second panel at an edge of the second panel opposite the closed edge portion. The method further comprises depositing a first adhesive layer on the interior side of the flap comprising a first remoistenable adhesive; depositing a solid dye on a portion of the first adhesive layer, wherein the dye is not visible on the exterior side of the flap; and depositing a second adhesive layer comprising a second remoistenable adhesive over the dye to encapsulate the dye. Advantageously, the dye is capable of being released upon contact with steam to provide a visual indication of the dye and an indication of tampering.

In accordance with a further aspect of the invention, a tamper evident sealing system for an envelope comprising a flap having an interior and an exterior side is disclosed. The system comprises a first remoistenable adhesive on the interior side of the flap; a solid dye deposited on a portion of the first remoistenable adhesive, wherein the dye is not visible on the exterior side of the flap; and a second remoistenable adhesive deposited over the dye to encapsulate the dye. Advantageously, the dye is capable of being released upon contact with steam to provide a visual indication of the dye and an indication of tampering.

In accordance with a further aspect of the invention, a tamper evident sealing system for an envelope comprises an alkaline remoistenable adhesive and a pH indicator, wherein the pH indicator is capable of changing color upon application of steam and to visually indicate tampering of the envelope.

In accordance with another aspect of the invention, a tamper evident moistening system comprises a liquid moistener for an envelope and a pH indicator, wherein the pH indicator is capable of changing color upon application of steam and to visually indicate tampering of the envelope.

In accordance with a still further aspect of the invention, a tamper resistant paper or cardboard envelope comprises a first panel with an interior and an exterior side; and a second panel attached to the first panel to define an interior portion having opposite side edges, a closed edge portion and an opening portion opposite the closed edge portion to provide access to the interior portion of the tamper resistant envelope. The envelope also comprises a flap for sealingly adhering to an exterior surface of the first panel. The flap has an interior and an exterior side and is attached to the second panel at an edge of the second panel opposite the closed edge portion. The envelope comprises thereon a first adhesive layer on the interior side of the flap comprising a first remoistenable adhesive deposited on the flap. A second adhesive layer comprising a second remoistenable adhesive is deposited on the exterior side of the first panel; and a solid dye is deposited on a portion of the second adhesive layer or embedded therewith. Advantageously, the dye is not visible on the exterior side of the flap and is capable of being released upon contact with steam to provide a visual indication of the dye and an indication of tampering. Alternatively, the solid dye may be embedded in a portion of the first adhesive layer.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
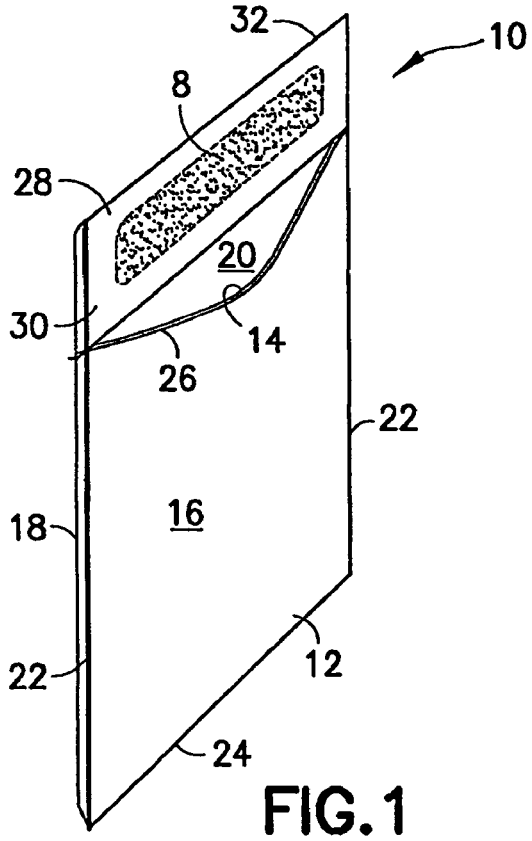
FIG. 1 is a perspective view of a tamper resistant envelope, in accordance with an embodiment of the invention.

Referring to FIG. 1, there is shown a schematic illustration of a first embodiment of the invention. Although the present invention will be described with reference to the embodiments shown in the drawings, it should be understood that the present invention can be embodied in many alternate forms of embodiments. In addition, any suitable size, shape or type of elements or materials could be used.

There is illustrated in FIG. 1 a tamper resistant envelope 10, in accordance with one embodiment of the invention. The envelope 10 is constructed with a tamper evident sealing system 8 that functions to prevent unauthorized access to the contents of envelope 10 and provide a visual indication of such unauthorized access.

Envelope 10 may be formed in any desired shape and size. For example, envelope 10 may be formed from a single sheet of material or multiple sheets of material. In the embodiment shown in FIG. 1, envelope 10 includes a first panel 12 with an interior side 14 and an exterior side 16 and a second panel 18 attached to the first panel 12 to define an interior portion 20 of the tamper resistant envelope 10. The envelope 10 also has opposite side edges 22, a closed edge portion 24 and an opening portion 26 opposite the closed edge portion 24 to provide access to the interior portion 20 of the tamper resistant envelope 10. In the embodiment shown in FIG. 2, the first panel 12 comprises a plurality of folded flaps 6, which are folded inwardly to produce a general, conventional V-shaped configuration 4.

Envelope 10 may be made out of any suitable material in any suitable thickness. Preferably, envelope 10 is constructed of paper or cardboard. A material thickness of about 0.0001 inches or greater is typical. Envelope 10 may also be constructed of a single layer or of multiple layers and may comprise a solid material preventing visual access of the contents of envelope 10. Alternatively, envelope 10 may comprise an opening portion (not shown), such as a conventional address window. The opening portion may be, for example, opaque, translucent, transparent or even completely open, depending upon the desired construction and use of envelope 10.

Figure 2:
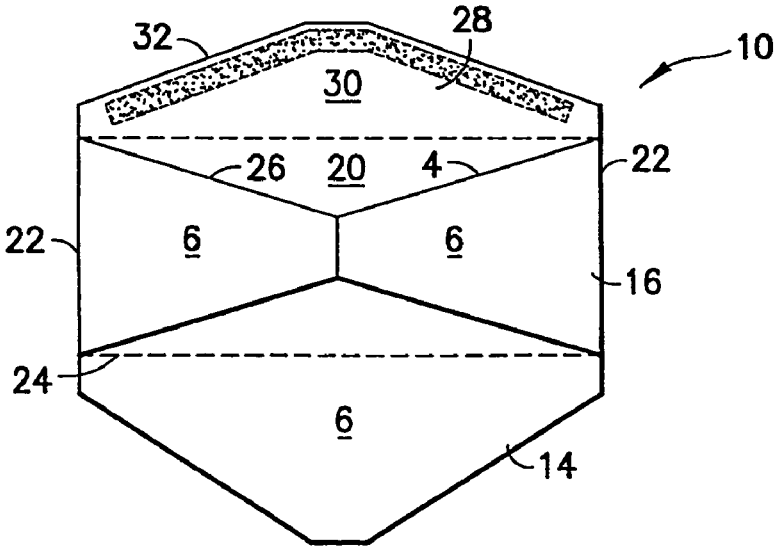
FIG. 2 shows another tamper resistant envelope, in accordance with embodiment of the invention.

As shown in FIGS. 1 and 2, the tamper resistant envelope 10 also includes a flap 28 for sealingly adhering to the exterior side 16 of the first panel 12. The flap 28 has an interior side 30 and an exterior side 32 and is attached to the second panel 18 at an edge of the second panel 18 opposite the closed edge portion 24.

Figure 3:
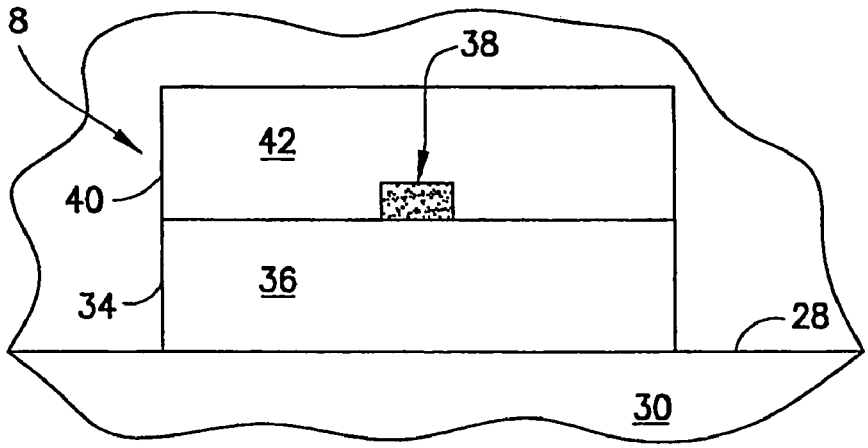
FIG. 3 is a schematic illustration of a portion of a tamper resistant envelope before sealing, in accordance with an embodiment of the invention.

As shown schematically in FIG. 3, the flap 28 comprises thereon the tamper evident sealing system 8. In the embodiment shown, the system 8 comprises a first adhesive layer 34 on the interior side 30 of the flap 28 comprising a first remoistenable adhesive 36. The system 8 further comprises a solid dye 38 deposited on at least a portion of the first adhesive layer 34 and a second adhesive layer 40 comprising a second remoistenable adhesive 42 deposited over the dye 38 to encapsulate the dye 38.

The first and second remoistenable adhesives 36, 42 may be any suitable adhesives that are activated upon contact with moisture. For example, suitable adhesives include conventional envelope gumming, glue, etc. Thus, the adhesives 36, 42 are not latex based adhesives. Further examples of suitable adhesives include water remoistenable gum seal adhesives sold by Borden Chemical of Columbus, Ohio (HM517), Dyna-tech Adhesives of Grafton, W.Va. (Flex-Tac272), National Starch and Chemical of Enoree, S.C. (Vinamul Series) and H. B. Fuller of St. Paul, Minn. (Products: EG2334SUB, PWE9120, X330511225 (Dextrin Based)). The first and second remoistenable adhesives 36, 42 are preferably the same, but can also be different. The adhesives 36, 42 may be deposited onto the interior side 30 of flap 28 by any conventional methods known in the art including, but not limited to, roller and spray deposition techniques.

The solid dye 38 may be any suitable nontoxic dye including, but not limited to, any food grade solid dye such as powdered FD&C Blue #2. Similarly, the dye 38 may be of various colors including, but not limited to blue, black, red, etc., dyes. The dye 38 may also be deposited by any conventional deposition methods including spraying and rolling techniques. The dye 38 may be deposited in any suitable amount and in any suitable pattern. For instance, a small amount of dye 38, such as about 0.001 grams or less, may be embedded by mechanical deposition or microencapsulation techniques. Preferably, dye 38 is deposited over the first adhesive layer 34 at its center, as shown in FIG. 3. Most preferably, the dye 38 is deposited in a fine powder form that is not visible to the eye on either the interior side 30 or exterior side 32 of the flap 28. However, in alternate embodiments the dye 38 could be visible on the interior side 30 the flap 28. Advantageously, the dye 38 is capable of being released upon contact with steam or soaking to provide a visual indication of the dye 38 and an indication of tampering.

Figure 4:
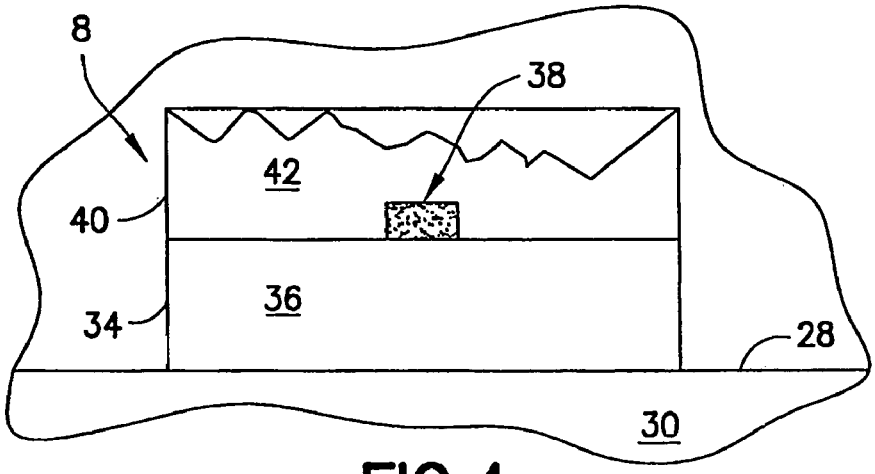
FIG. 4 is a schematic illustration of a portion of a tamper resistant envelope after sealing, in accordance with an embodiment of the invention.
Figure 5:
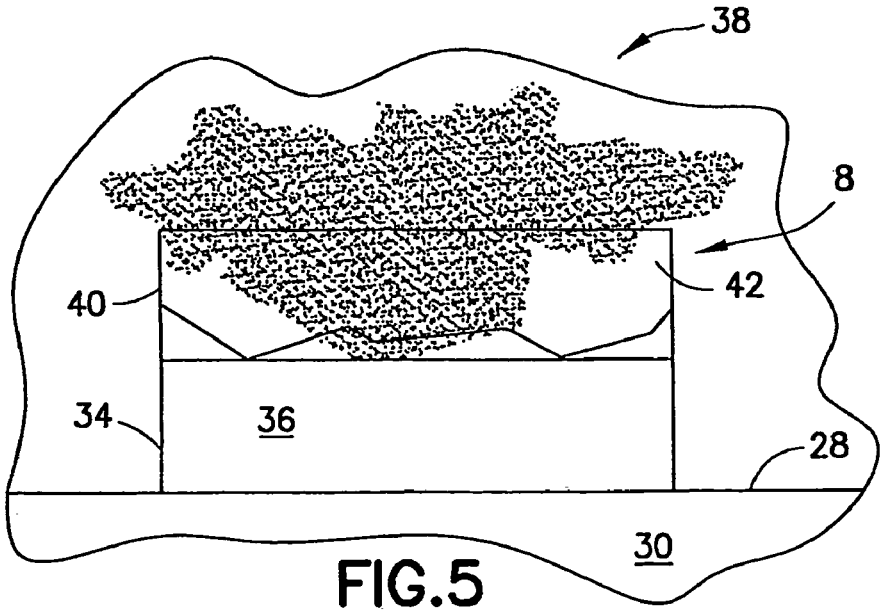
FIG. 5 is a schematic illustration of a portion of a tamper resistant envelope upon tampering, in accordance with an embodiment of the invention.
Figure 6:
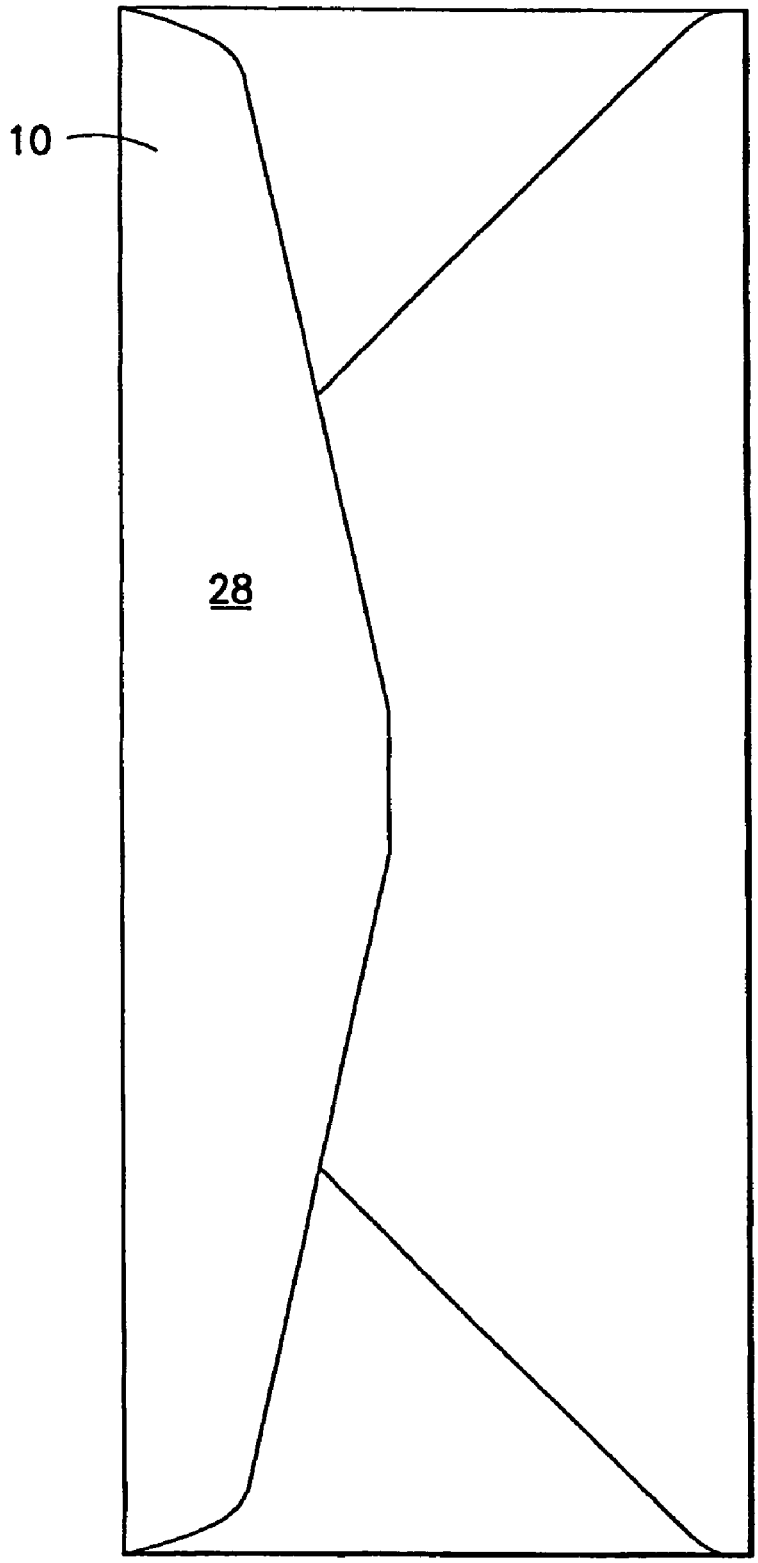
FIG. 6 shows a tamper resistant envelope before steaming the sealed envelope, in accordance with an embodiment of the invention.
Figure 7:
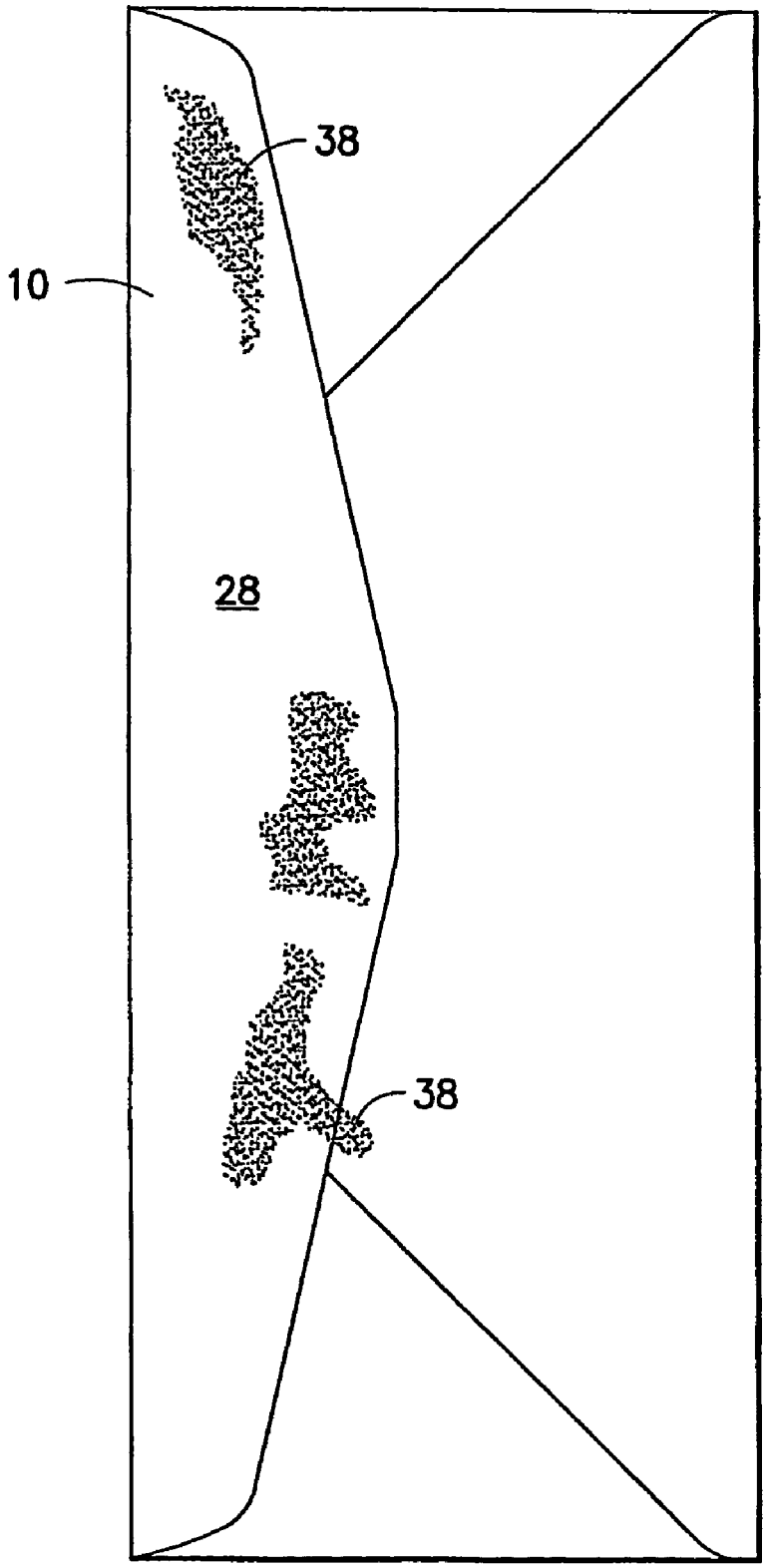
FIG. 7 shows a tamper resistant envelope after steaming the sealed envelope of FIG. 6, in accordance with an embodiment of the invention.

As shown schematically in FIG. 4, when the envelope 10 including the afore-described sealing system 8 is first moistened and sealed, which may be accomplished by manual or automated sealing methods, the second adhesive layer 40 is only partially dissolved and thus the dye 38 is not released. However, upon subsequent contact with a large amount of water or moisture, such as by steaming or soaking, the dye 38 dissolves and spreads into the flap 28 resulting in a permanent colored stain that is easily identifiable, as shown in FIG. 5. Similarly, FIGS. 6 and 7 show a sealed envelope 10 before and after steaming, respectively. As can be seen from these figures, upon application of the tamper evident sealing system 8 and even after initial moistening to seal the envelope 10, the exterior side 32 of flap 28 is not discolored by the dye 38. Only after subsequent steaming is the dye released to visually indicate tampering.

A further embodiment of the invention will be described by way of example, which is meant to be merely illustrative and therefore not limiting.

EXAMPLE

Figure 8:
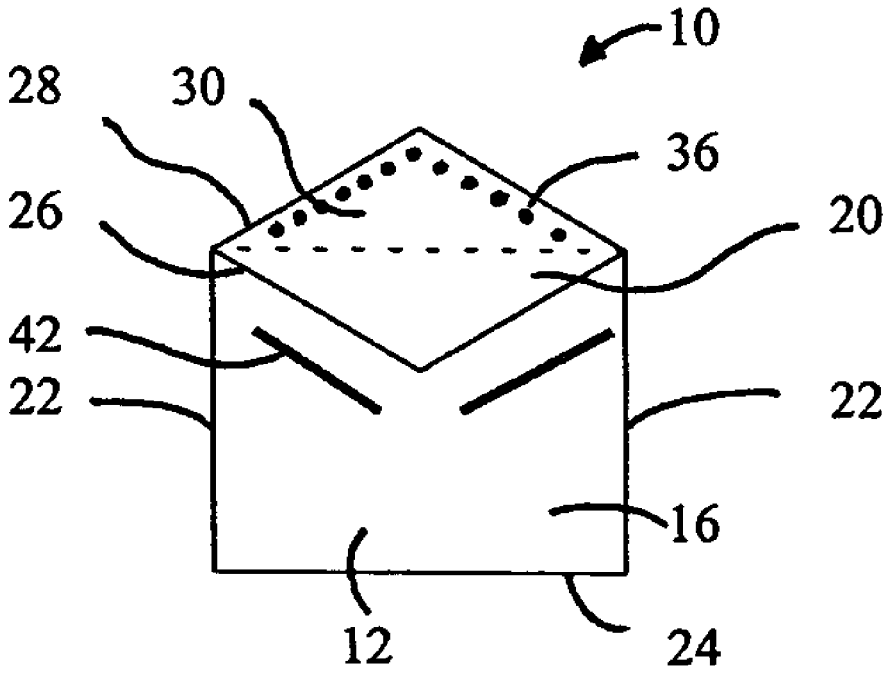
FIG. 8 shows a further construction of a tamper resistant envelope, in accordance with an embodiment of the invention.

As shown schematically in FIG. 8, which illustrates an alternative embodiment of the invention, two four inch strips of 3M adhesive transfer tape were placed opposite the flap 28 on the envelope 10. Next, about 0.001 grams of Acid Blue #9 (Food Blue 2) dye 38 was sprinkled evenly on the adhesive tape. The gum adhesive on the envelope 10 was moistened and the envelope 10 was sealed and allowed to dry. No color was present on the exterior or interior side of flap 28 after sealing. The envelope 10 was then subjected to steam produced by running hot tap water. The envelope 10 did not get directly wet, but the steam dampened the flap 28 and caused a visible color stain to be produced.

Thus, in the above embodiment, the first remoistenable adhesive 36 (conventional envelope gumming in this example) may deposited on the interior of flap 28, as described above. The second remoistenable adhesive 42 may be applied to the exterior side 16 of envelope 10 (adhesive tape strip in this example). Dye 38 (Acid Blue #9 in this example) may be deposited along the adhesive 42 and the envelope 10 sealed. Alternatively, the dye 38 may be embedded in the first remoistenable or second remoistenable adhesive 36, 42 upon application.

In accordance with a further embodiment of the invention, the tamper evident sealing system 8 comprises at least one of the first and second adhesives 36, 42 in the form of an alkaline adhesive. In particular, a pH adjuster, such as triethanolamine, may be added to adjust the pH of the at least one adhesive 36, 42 to basic. The tamper evident sealing system 8 further comprises a water soluble pH indicator admixed therewith. Preferably, the pH indicator has a transition point of about pH=7. Suitable conventional pH indicators include, but are not limited to, creosol red (red to yellow), thymol blue (blue to yellow) and litmus (blue to red). For example, a pH indicator such as phenol red (phenolsulphonephthaline) is red at a pH above 7, but changes to yellow at a pH below 7. As steam is acidic when it comes into contact with phenol red, it will change the color from red to yellow. To embed the pH indicator in, for example, a gum seal envelope adhesive, the pH of the adhesive should be measured. If the pH of the adhesive is basic (i.e. greater than 7) then the indicator may be directly added and the adhesive applied to an envelope. As noted above, if the pH of the tested adhesive is acidic (i.e. less than 7) then a pH adjuster, such as triethanolamine, may be added dropwise to the adhesive until the pH measures about 7.5 to create the alkaline adhesive.

Accordingly, as steam is slightly acidic with a pH of about 6.5, upon application of steam to sealed envelope 10 including the tamper evident sealing system 8, a colorless pH indicator will change the color of adhesive 36, 42 to a desired color and visually indicate tampering. In further embodiments, the adhesive 36, 42 could also include a colored pH indicator such that the indicator will change the color of adhesive 36, 42 from the initial color of the pH indicator to a different, desired color upon exposure to steam at a pH of about 6.5.

In accordance with yet another embodiment of the invention, a tamper evident moistening system is disclosed. Thus, instead of doping an envelope adhesive with a pH indicator, it may be added when the adhesive is remoistened to seal the envelope. The tamper evident moistening system comprises the afore-described pH indicator, which may be colored or colorless, admixed with a liquid envelope moistener, such as the E-Z Seal® product sold by Pitney Bowes of Stamford, Conn. Although the liquid envelope moistener may be any suitable moistener, aqueous based moisteners, such as the above Pitney Bowes product, are preferred. Similarly, a mixture of water and pH indicator may also be employed. Upon application to, for example, the interior side 30 of flap 28, it will preferably invisibly stain the interior side 30. Alternatively, the interior side 30 may be stained in any desired color depending, for example, upon the color of the pH indicator. If steam or soaking is used to try and open the envelope 10, the pH indicator will change color leaving a permanent stain on the exterior side 32 of flap 28. Accordingly, any mail sealed with this system may be deemed "tamper resistant."

In accordance with yet another embodiment of the present application, the tamper indicating material such as dye is placed on more than one flap of the envelope. Additionally, the tamper indicating material such as the dye is alternatively placed on the external side of the flap on the outside of the envelope.

It should be understood that the foregoing description is only illustrative of the invention. Various alternatives and modifications can be devised by those skilled in the art without departing from the invention. Accordingly, the present invention is intended to embrace all such alternatives, modifications and variances that fall within the scope of the appended claims.

What is claimed is:

1. A tamper resistant envelope comprising:

a first panel with an interior and an exterior side;

a second panel attached to the first panel to define an interior portion having opposite side edges, a closed edge portion and an opening portion opposite the closed edge portion to provide access to the interior portion of the tamper resistant envelope; and a flap for sealingly adhering to an exterior surface of the first panel, the flap having an interior and an exterior side and attached to the second panel at an edge of the second panel opposite the closed edge portion, the flap comprising thereon:

a first adhesive layer on the interior side of the flap comprising a first remoistenable adhesive deposited on the flap;

a solid dye deposited on a portion of the first adhesive layer, wherein the dye is not visible on the exterior side of the flap; and a second adhesive layer comprising a second remoistenable adhesive deposited over the dye to encapsulate the dye, wherein the dye is capable of being released upon contact with steam to provide a visual indication of the dye and an indication of tampering.

2. The tamper resistant envelope of claim 1, wherein the first remoistenable adhesive is a glue or gumming.

3. The tamper resistant envelope of claim 2, wherein the first remoistenable adhesive and the second remoistenable adhesive are the same.

4. The tamper resistant envelope of claim 1, wherein the dye is a powdered dye.

5. The tamper resistant envelope of claim 4, wherein the dye is a solid blue or black dye.

6. The tamper resistant envelope of claim 4, wherein the dye is not visible on the interior side of the flap.

7. The tamper resistant envelope of claim 6, wherein the envelope is constructed of cardboard or paper.

8. A method of making a tamper resistant envelope comprising:

providing an envelope comprising:

a first panel with an interior and an exterior side;

a second panel attached to the first panel to define an interior portion having opposite side edges, a closed edge portion and an opening portion opposite the closed edge portion to provide access to the interior portion of the envelope; and a flap for sealingly adhering to an exterior surface of the first panel, the flap having an interior and an exterior side and attached to the second panel at an edge of the second panel opposite the closed edge portion;

depositing:

a first adhesive layer on the interior side of the flap comprising a first remoistenable adhesive;

a solid dye on a portion of the first adhesive layer, wherein the dye is not visible on the exterior side of the flap; and a second adhesive layer comprising a second remoistenable adhesive over the dye to encapsulate the dye, wherein the dye is capable of being released upon contact with steam to provide a visual indication of the dye and an indication of tampering.

9. The method of claim 8, wherein the first remoistenable adhesive is a glue or gumming.

10. The method of claim 8, wherein the first remoistenable adhesive and the second remoistenable adhesive are the same.

11. The method of claim 8, wherein the dye is powdered dye.

12. The method of claim 11, wherein the dye is a solid blue or black dye.

13. The method of claim 12, wherein the dye is not visible on the interior side of the flap.

14. The method of claim 13, wherein the envelope is constructed of cardboard or paper.

15. A tamper evident sealing system for an envelope comprising a flap having an interior and an exterior side, the system comprising:

a first remoistenable adhesive on the interior side of the flap;

a dye deposited on a portion of the first remoistenable adhesive, wherein the dye is not visible on the exterior side of the envelope;

a second remoistenable adhesive deposited over the dye to encapsulate the dye, wherein the dye is capable of being released upon contact with steam to provide a visual indication of the dye and an indication of tampering.

16. The tamper evident sealing system of claim 15, wherein the first remoistenable adhesive is a glue or gumming.

17. The tamper evident sealing system of claim 15, wherein the first remoistenable adhesive and the second remoistenable adhesive are the same.

18. The tamper evident sealing system of claim 15, wherein the dye is a powdered dye.

19. The tamper evident sealing system of claim 18, wherein the dye is a solid blue or black dye.

20. The tamper evident sealing system of claim 18, wherein the dye is not visible on the interior side of the flap.

21. The tamper evident sealing system of claim 20, wherein the envelope is constructed of cardboard or paper.

22. A tamper resistant envelope comprising:

a first panel with an interior and an exterior side;

a second panel attached to the first panel to define an interior portion having opposite side edges, a closed edge portion and an opening portion opposite the closed edge portion to provide access to the interior portion of the tamper resistant envelope; and a flap for sealingly adhering to an exterior surface of the first panel, the flap having an interior and an exterior side and attached to the second panel at an edge of the second panel opposite the closed edge portion, the envelope comprising thereon:

a first adhesive layer on the interior side of the flap comprising a first remoistenable adhesive deposited on the flap;

a second adhesive layer comprising a second remoistenable adhesive deposited on the exterior side of the first panel; and a solid dye deposited on a portion of the second adhesive layer or embedded therewith, wherein the dye is not visible on the exterior side of the flap and the dye is capable of being released upon contact with steam to provide a visual indication of the dye and an indication of tampering.

23. A tamper resistant envelope comprising:

a first panel with an interior and an exterior side;

a second panel attached to the first panel to define an interior portion having opposite side edges, a closed edge portion and an opening portion opposite the closed edge portion to provide access to the interior portion of the tamper resistant envelope; and a flap for sealingly adhering to an exterior surface of the first panel, the flap having an interior and an exterior side and attached to the second panel at an edge of the second panel opposite the closed edge portion, the paper or cardboard envelope comprising thereon:

a first adhesive layer on the interior side of the flap comprising a first remoistenable adhesive deposited on the flap;

a solid dye embedded in a portion of the first adhesive layer, wherein the dye is not visible on the exterior side of the flap; and a second adhesive layer comprising a second remoistenable adhesive deposited on the exterior side of the first panel, wherein the dye is capable of being released upon contact with steam to provide a visual indication of the dye and an indication of tampering.

* * * * *